US005736741A

United States Patent [19]

Bertsch et al.

[11] Patent Number: 5,736,741

[45] Date of Patent: Apr. 7, 1998

[54] IONIZATION CHAMBER AND MASS SPECTROMETRY SYSTEM CONTAINING AN EASILY REMOVABLE AND REPLACEABLE CAPILLARY

[75] Inventors: James L. Bertsch, Palo Alto; Kent D. Henry, Newark, both of Calif.

[73] Assignee: Hewlett Packard Company, Palo Alto, Calif.

[21] Appl. No.: 688,586

[22] Filed: Jul. 30, 1996

[51] Int. Cl.[6] ..... H01J 49/04

[52] U.S. Cl. ..... 250/288; 73/864.51

[58] Field of Search ..... 250/288, 288 A; 73/864.81

[56] References Cited

U.S. PATENT DOCUMENTS

| | | | |
|---|---|---|---|
| 3,867,631 | 2/1975 | Briggs et al. | 250/281 |
| 4,542,293 | 9/1985 | Fenn et al. | 250/288 |
| 4,641,541 | 2/1987 | Sharp | 73/864.81 |
| 4,977,320 | 12/1990 | Chowdhury et al. | 250/288 |
| 4,982,097 | 1/1991 | Slivon et al. | 250/288 |
| 5,030,826 | 7/1991 | Hansen | 250/288 |
| 5,122,670 | 6/1992 | Mylchreest et al. | 250/288 |
| 5,235,186 | 8/1993 | Robins | 250/288 |
| 5,272,337 | 12/1993 | Thompson et al. | 250/288 |
| 5,289,003 | 2/1994 | Musser | 250/288 |
| 5,304,798 | 4/1994 | Tomany et al. | 250/288 |
| 5,416,322 | 5/1995 | Chace et al. | 250/288 |

FOREIGN PATENT DOCUMENTS

| | | |
|---|---|---|
| 52-66488 | 1/1977 | Japan . |
| 59-845 A | 1/1984 | Japan . |
| 1-146242 A | 6/1989 | Japan . |
| 4-132153 A | 5/1992 | Japan . |
| 85/02490 A1 | 6/1985 | WIPO . |

*Primary Examiner*—Jack I. Berman
*Attorney, Agent, or Firm*—Janet Pauline Clark

[57] ABSTRACT

The invention relates to an ionization chamber. More particularly, the invention relates to a mass spectrometry system having an ionization chamber containing an easily removable and replaceable capillary.

19 Claims, 5 Drawing Sheets

IONIZATION CHAMBER AND MASS SPECTROMETRY SYSTEM CONTAINING AN EASILY REMOVABLE AND REPLACEABLE CAPILLARY

The present invention relates to an ionization chamber. More particularly, the present invention relates to a mass spectrometry system having an ionization chamber containing an easily removable and replaceable capillary.

BACKGROUND

Mass spectrometers employing atmospheric pressure ionization (API), including atmospheric pressure chemical ionization (APCI) and electrospray ionization (ESI), have been demonstrated to be particularly useful for obtaining mass spectra from liquid samples and have widespread application. Mass spectrometry (MS) is frequently used in conjunction with gas chromatography (GC) and liquid chromatography (LC), and combined GC/MS and LC/MS systems are commonly used in the analysis of analytes containing molecules having a wide range of molecular weights and polarities. Combined LC/MS systems have been particularly useful for applications such as protein and peptide sequencing, molecular weight analysis, environmental monitoring, pharmaceutical analysis, and the like.

APCI may be used in conjunction with gaseous or liquid samples. In APCI-MS of liquid samples, in one preferred operating mode, a liquid sample containing solvent and analyte is converted from liquid to gaseous phase, followed by ionization of the sample molecules (solvent and analyte). Such systems frequently employ nebulizers, optionally with pneumatic, ultrasonic, or thermal "assists", to break up the stream of liquid entering the nebulizer into fine, relatively uniformly sized droplets which are then vaporized. Ionization of the vaporized solvent and analyte molecules occurs under the influence of a corona discharge generated within the APCI chamber by an electrically conductive corona needle to which a high voltage electrical potential is applied. In APCI with liquid samples, the solvent molecules serve the same function as the reagent gas in chemical ionization mass spectrometry (CIMS). The solvent molecules are ionized by passing through a high electric field gradient or corona discharge created at the tip of the corona needle (electrode). The ionized solvent molecules then ionize the analyte molecules. The exact chemical reactions and resulting ions depend upon the composition of the solvent, whether APCI is operated in positive or negative mode, and the chemical nature of the analyte. More than one type of ion may be formed, leading to multiple mechanisms for ionization of the analyte. The ionized analyte molecules (separated from the vaporized and ionized solvent molecules) are then subsequently focussed and analyzed by conventional MS techniques.

ESI is a technique that generates a charged dispersion or aerosol, typically at or near atmospheric pressure and ambient temperature. Since ESI generally operates at ambient temperatures, labile and polar samples may be ionized without thermal degradation and the mild ionization conditions generally result in little or no fragmentation. Variations on ESI systems optionally employ nebulizers, such as with pneumatic, ultrasonic, or thermal "assists", to improve dispersion and uniformity of the droplets. The aerosol is produced by passing the liquid sample containing solvent and analyte through a hollow needle which is subjected to an electrical potential gradient (operated in positive or negative mode). The high electric field gradient at the end of the hollow needle charges the surface of the emerging liquid, which then disperses due to the "assists" and the Columbic forces into a fine spray or aerosol of charged droplets. Subsequent heating or use of an inert drying gas such as nitrogen or carbon dioxide is typically employed to evaporate the droplets and remove solvent vapor prior to MS analysis. The ionized analyte molecules (separated from the vaporized and ionized solvent molecules) are then subsequently focussed and analyzed by conventional MS techniques.

In both APCI-MS and ESI-MS, ionized analyte molecules pass from the ionization chamber into a subsequent chamber or chambers at lower pressure, preferably under vacuum. An ion guide such as a capillary or orifice located between the ionization chamber and a subsequent lower pressure chamber is used to transport charged analyte molecules from the ionization chamber to the lower pressure chamber and ion optics. Use of a dielectric capillary rather than an orifice enables each end of the capillary to be held at different electrical potentials, provides improved momentum focussing of the ions, and allows the nebulizer to be at ground potential. The capillaries used are typically on the order of about 0.3 millimeters to about 1.0 millimeters inner diameter and typically are from about 50 millimeters to about 1,000 millimeters in length.

During operation, the capillary may become fouled or plugged with unevaporated or condensed solvent or analyte, or other contaminants. The capillary therefore must frequently be removed for cleaning or replacement in order to maintain optimum performance of the system. Currently, in order to remove the capillary, a multistep procedure involving several tools must be used. Typically, with current systems, before removing the capillary the mass spectrometer must be vented after cooling the ionization source or chamber and capillary. In many prior art designs, access to the capillary is gained only after a significant amount of disassembly of the the ionization chamber and other pads which block access to the capillary. Electrical connections supplying power to the parts associated with the capillary must also be disconnected. Finally, the capillary vacuum seal must be broken and the capillary removed. Tools are typically employed in gaining access to the capillary and breaking the capillary vacuum seal.

After cleaning or replacement, the capillary is installed, again using tools. During installation, special "alignment" tool kits are often used to insure and verify that the capillary is properly and precisely positioned and aligned in both axial and radial directions. The parts removed to gain access to the capillary must be replaced and the electrical connections reconnected, again using tools. The ionization chamber is then closed and the mass spectrometer is pumped down to the desired level of vacuum and heating to the thermal zones is reinitiated.

Such disassembly and reassembly procedures are inconvenient, time consuming, and result in significant down time, so the capillary is frequently not removed as often as desirable to maintain optimum performance. In addition, slight misalignments of the capillary upon reinstallation may have a significant detrimental impact on performance of the system.

What is needed is a capillary that is easily and quickly removed, for inspection, cleaning, or replacement, without the need for tools. What is further needed is a capillary that is easily and quickly installed into proper and precise position and alignment without the need for tools.

SUMMARY OF THE INVENTION

In one embodiment, the invention relates to an ionization chamber comprising: a housing; at least one ionization region; a capillary assembly, wherein the capillary assembly provides a means of communication between the ionization region and a lower pressure region; a capillary receptacle; means of sealing the capillary assembly within the capillary receptacle; and means of supplying an electrical potential to the capillary assembly; wherein the capillary assembly is self-positioning and is sealing engaged within the capillary receptacle such that under tension an axial sliding or lateral movement is enabled which disconnects the means of supplying an electrical potential to the capillary assembly and removes the capillary assembly from the capillary receptacle without using tools.

In another embodiment, the invention relates to a mass spectrometry system comprising: a housing; at least one ionization region; a capillary assembly, wherein the capillary assembly provides a means of communication between the ionization region and a lower pressure region; a capillary receptacle; means of sealing the capillary assembly within the capillary receptacle; and means of supplying an electrical potential to the capillary assembly; wherein the capillary assembly is self-positioning and is sealing engaged within the capillary receptacle such that under tension an axial sliding or lateral movement is enabled which disconnects the means of supplying an electrical potential to the capillary assembly and removes the capillary assembly from the capillary receptacle without using tools.

These and other embodiments of the invention are described hereinafter.

DETAILED DESCRIPTION

Figure 1:
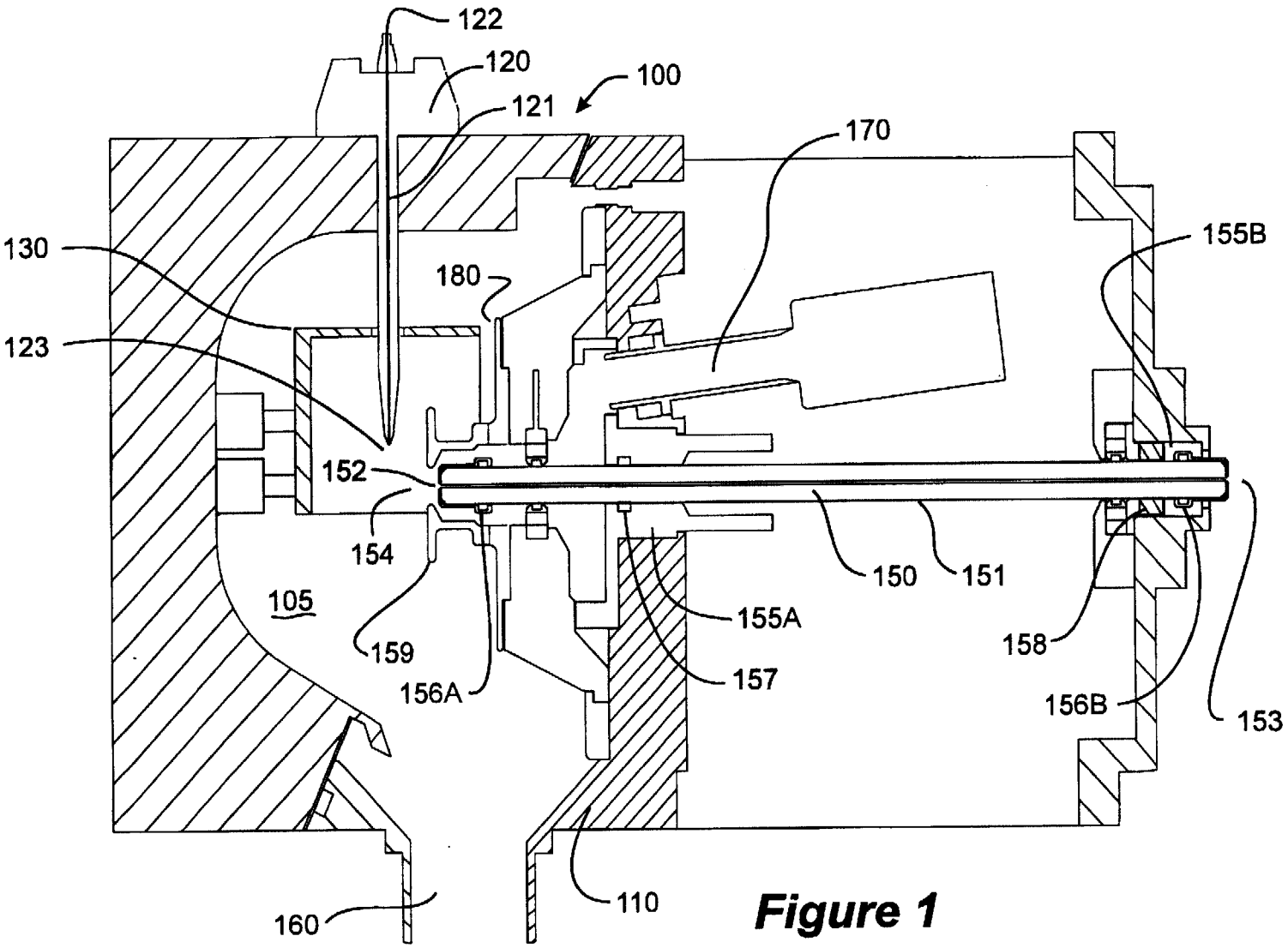
FIG. 1 is a schematic drawing of a preferred atmospheric pressure electrospray ionization chamber of the invention.

In the preferred embodiment illustrated in FIG. 1, an ionization chamber (100), for example, an electrospray ionization chamber, comprises a housing (110) containing at least one ionization region (105), preferably an atmospheric pressure ionization region, an electrospray nebulizer assembly (120), an electrode (130), a means of supplying an electrical potential (not shown) to the electrode (130), a capillary assembly (150) and a capillary receptacle (155A and 155B), optionally a drain port or vent (160), optionally a means of supplying drying gas (170), an end plate (180), a means of supplying an electrical potential (not shown) to the end plate (180), and a means of supplying an electrical potential to the capillary assembly (not shown).

The housing (110) of the ionization chamber (100) may be fabricated from any material providing the requisite structural integrity and which does not significantly degrade, corrode, or otherwise outgas under typical conditions of use. Typical housings are fabricated from materials including metals such as stainless steel, aluminum, and aluminum alloys, glass, ceramics, and plastics such as Delrin acetal resin (trademark of Du Pont) and Teflon fluorocarbon polymer (trademark of Du Pont). Composite or multilayer materials may also be used. In a preferred embodiment, the housing is fabricated from an aluminum alloy.

In FIG. 1, the electrospray assembly (120) and capillary assembly (150) and capillary receptacle (155A and 155B) are shown arranged in a substantially orthogonal or a cross-flow orientation; in such orientation, the angle between the axial centerlines of the electrospray assembly (120) and the capillary assembly (150) and capillary receptacle (155A and 155B) is preferably about 75 degrees to about 105 degrees, more preferably at or about 90 degrees. However, other configurations are possible such as as substantially linear, angular, or off-axis orientations.

As illustrated in FIG. 1, the electrospray assembly (120) comprises a hollow needle (121) with an inlet (122) to receive liquid samples, such as from a liquid chromatograph, flow injector, syringe pump, infusion pump, or other sample introduction means, and an exit (123). An optional concentric tube or sheath with inlet and exit and which surrounds the hollow needle (121) may be used to introduce nebulizing gas to assist in the formation of the aerosol. Other "assisted" electrospray techniques can be used in conjunction with the present invention, such as ultrasonic nebulization. The electrospray assembly (120) is typically fabricated from stainless steel, and optionally includes fused silica.

The electrode (130) is preferably cylindrical and encompasses the exit (123) of the electrospray assembly (120). The electrode (130) is preferably fabricated from a material providing the requisite structural strength and durability and is electrically conductive, such as stainless steel. Means of supplying an electrical potential to the electrode (130) typically include wires and passive electrical contacts (not shown). During operation, a potential difference is generated between the electrode (130) and the electrospray assembly exit (123) on the order of about 0.5 to kV to about 8.0 kV. The electrode (130) may be operated in positive or negative mode.

Figure 4:
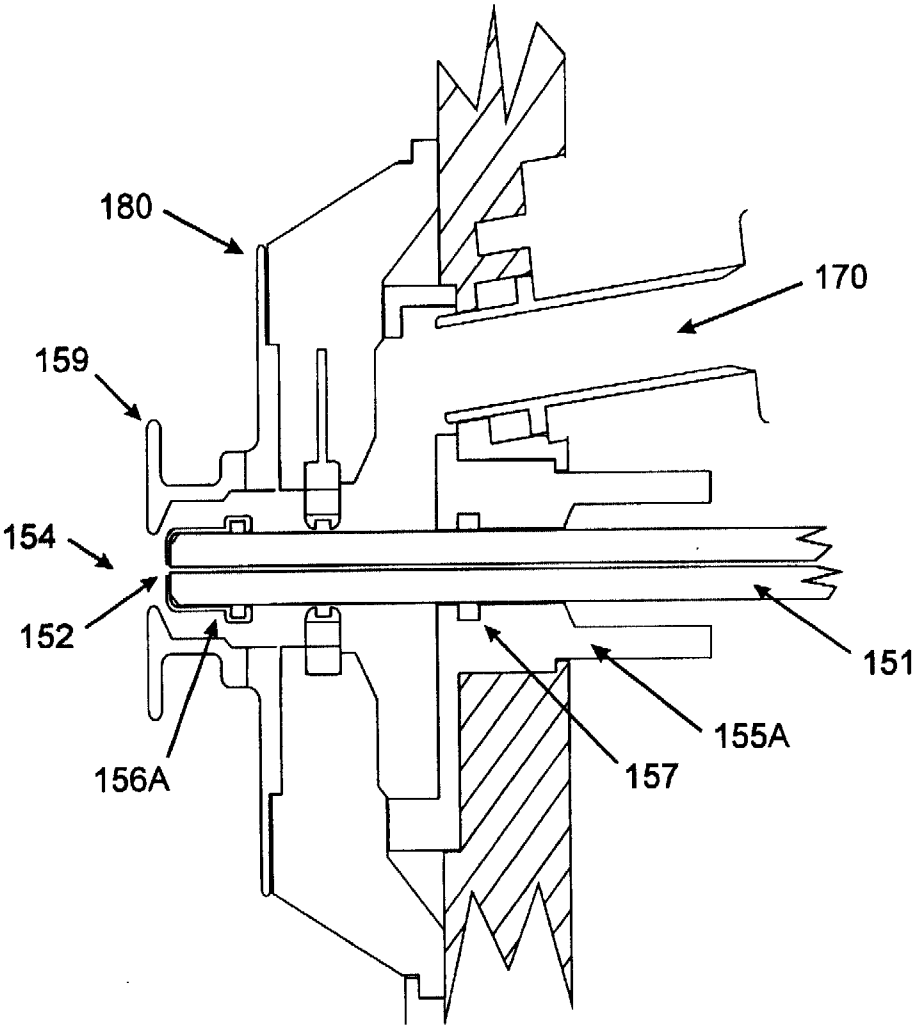
FIG. 4 is an enlarged view of a schematic drawing of a preferred ionization chamber of the invention, illustrating the inlet end of a capillary.
Figure 5:
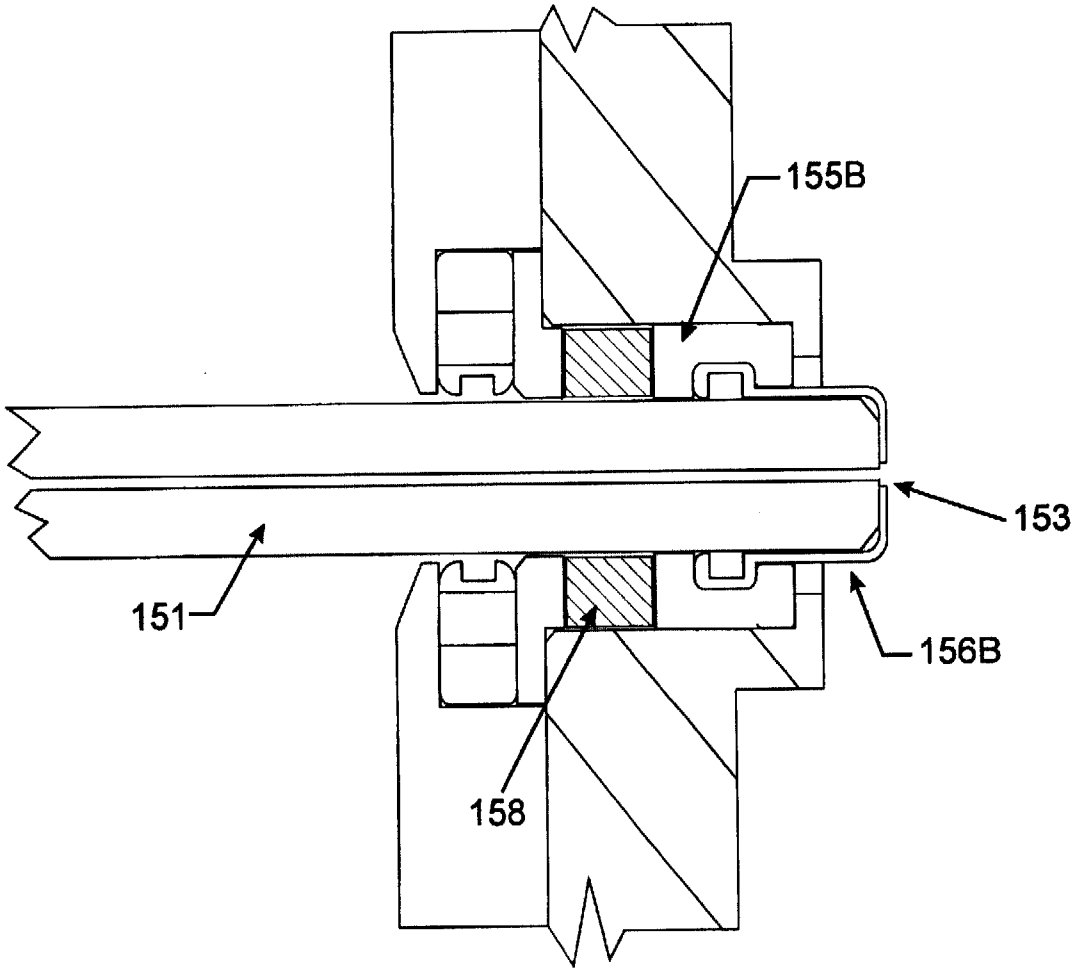
FIG. 5 is an enlarged view of a schematic drawing of a preferred ionization chamber of the invention, illustrating the exit end of a capillary.

As illustrated in FIGS. 1, 4, and 5, the capillary assembly (150) and capillary receptacle (155A and 155B) comprise a capillary (151) with an inlet (152) and an exit (153), optional means of introducing drying gas (170) into the ionization region (105) of the ionization chamber (100), and end plate (180) with opening (154). The capillary (151) is optionally metal plated at each end and further optionally has a capillary inlet cap (156A) and a capillary exit cap (156B). Use of a capillary inlet cap (156A) increases the robustness and longevity of the capillary (151) by reducing the amount of chemical species deposited directly in or on the inlet (152) end of the capillary. The capillary exit cap (156B) is one way of providing a means of accurately and precisely positioning and aligning the capillary in axial and radial directions. The capillary (151) is typically fabricated from glass and metal and provides a means of communicating between the ionization region (105) and subsequent lower pressure regions, preferably vacuum regions, of the mass spectrometer.

The capillary (151) fits within capillary exit receptacle (155B) in housing (110) and means of locating the capillary (151) such that the capillary position and alignment is accurately and precisely fixed into proper axial and radial position relative to the subsequent focussing skimmers and lenses is provided, such as by the capillary exit cap (156B). Thus, the capillary (151) is self-positioning, since it is automatically fixed into proper position upon being placed in the capillary exit receptacle (155B) and no tools are required to verify the alignment and position of the capillary (151). The tolerances are fixed so that the capillary (151) fits within the capillary receptacle (155A and 155B) such that under tension an axial sliding or lateral motion is enabled. Typical tolerances are on the order of plus or minus about 0.005 inches (0.127 millimeters), more preferably on the order of plus or minus about 0.0005 inches (0.0127 millimeters).

Means of sealing the capillary (151) into the capillary receptacle (155A and 155B) in housing (110) is provided by the capillary ionization seal (157) and the capillary vacuum seal (158). Seals, such as spring loaded Teflon fluorocarbon polymer (trademark of Du Pont) seals known as Bal seals (trademark of Bal Seal Engineering Company, Inc.), or similar seals, are employed to seal the capillary (151) within the capillary receptacle (155A and 155B) such that axial sliding or lateral motion when tension is applied enables the capillary (151) to be removed from the capillary receptacle (155A and 155B) without the use of tools. The purpose of the capillary ionization seal (157) is to provide a means of sealing the ionization region (105) so that all chemical species exit the ionization region only via designated exits such as the optional drain port or vent (160) or the capillary inlet (151). The purpose of the capillary vacuum seal (158) is to provide a means of sealing with respect to subsequent lower pressure regions, preferably vacuum regions, or chambers (300) and mass analyzers (330) (illustrated in FIG. 3). An end cap (159) is provided such that it screws, snaps, or is otherwise placed in position over the capillary (151) and optional capillary inlet cap (156A).

Means of providing an electrical potential to the capillary assembly may be made at one or, in the case of a dielectric capillary, both ends of the capillary. Such means may be made via electrical connections using, for example, passive spring-loaded contacts. In one embodiment with a dielectric capillary, at each end of the capillary are stainless steel rings. In each ring is press-fit a male pin which mates with a female receptacle located at the end of a wire bearing the high voltage electrical potential. The rings either surround, and thus contact, a torroidal spring or are welded to thin sheet metal, which provide the spring loaded contact to the metal plated ends of the capillary, thus providing high voltage electrical potentials to the metal plated ends of the capillary and the capillary inlet cap and capillary exit cap.

Figure 2:
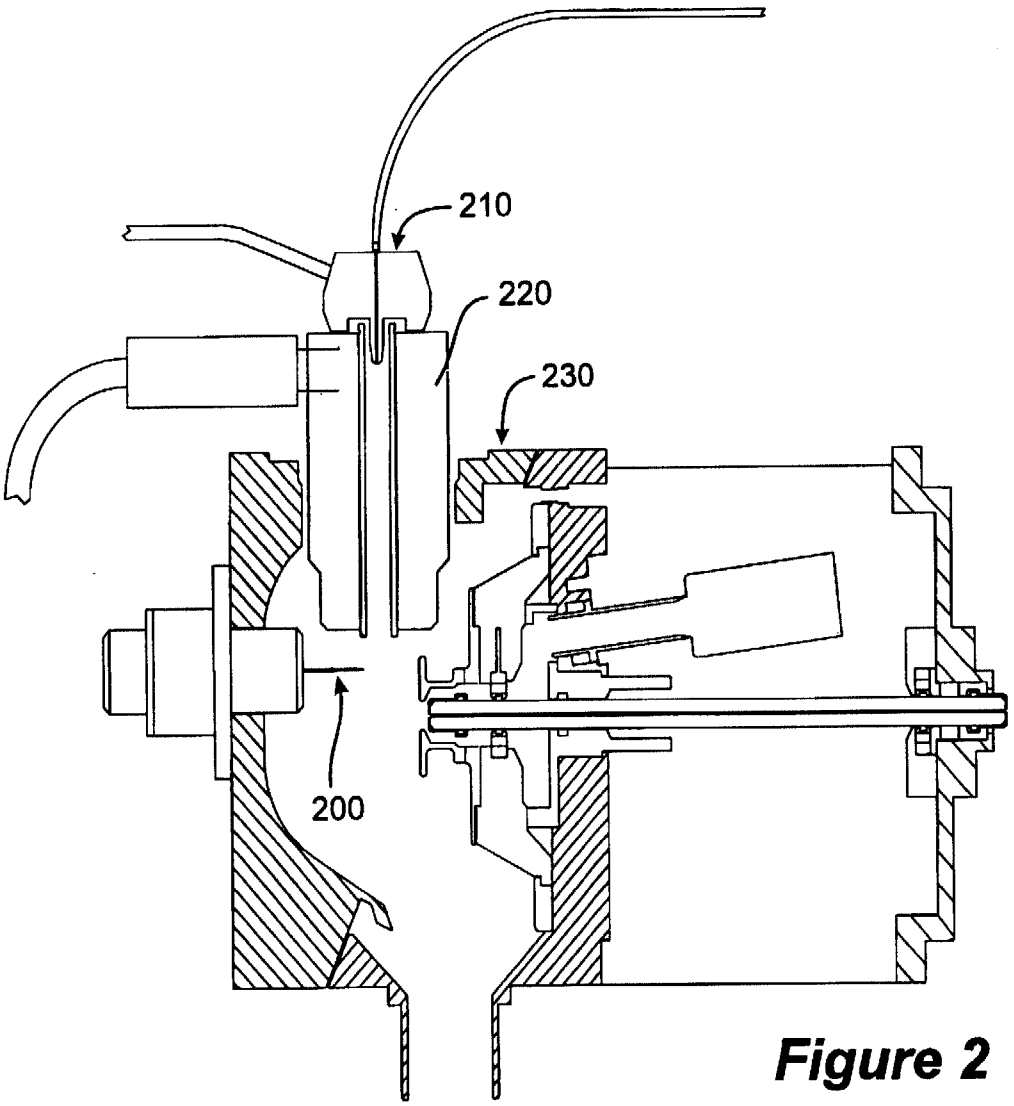
FIG. 2 is a schematic drawing of a preferred atmospheric pressure chemical ionization chamber of the invention.

FIG. 2 illustrates a preferred embodiment of the invention wherein the ionization chamber is an atmospheric pressure chemical ionization chamber (230) containing a corona needle assembly (200). A nebulizer assembly (210) is surrounded by a vaporizer assembly (220). Other elements of the embodiment are as described in FIG. 1.

Figure 3:
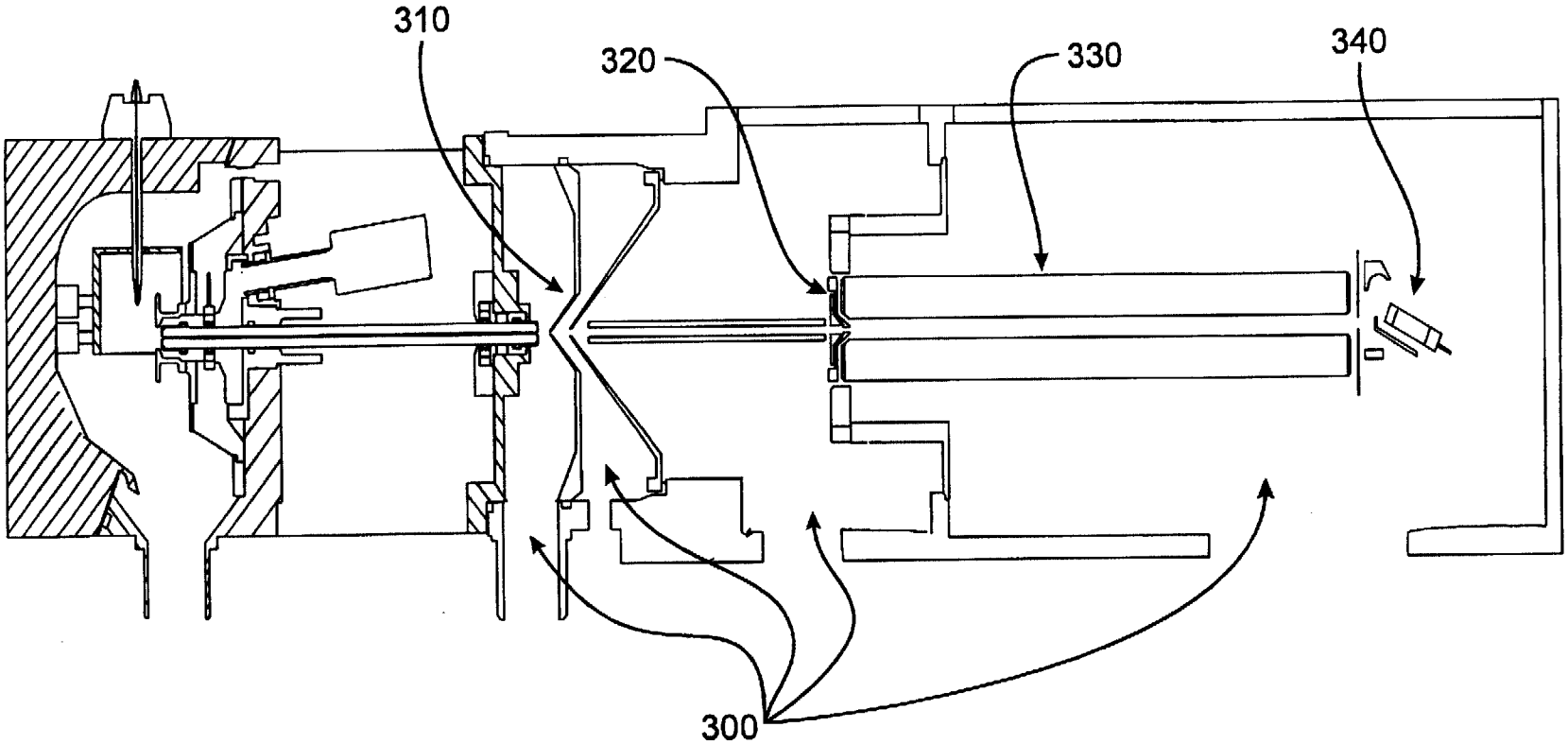
FIG. 3 is a schematic drawing of a preferred atmospheric pressure electrospray ionization mass spectrometry system of the invention.

FIG. 3 illustrates a preferred embodiment of the invention wherein the preferred electrospray ionization chamber of FIG. 1 is employed in a mass spectrometry system. The mass spectrometry system comprises multiple lower pressure, preferably vacuum, chambers (300), skimmers (310), lenses (320), quadrupole mass analyzer (330), pumps (not shown) and detector (340). Although a quadrupole mass spectrometer is illustrated, any conventional mass spectrometer may be used in conjunction with the ionization chamber of this invention, including but not limited to quadrupole or multipole, electric or magnetic sector, Fourier transform, ion trap, and time-of-flight mass spectrometers.

With reference to FIGS. 1 and 2, during operation a liquid sample containing analyte enters the electrospray assembly (120) or nebulizer assembly (210) and is introduced into the atmospheric pressure region (105) of ionization chamber (100) or (230). Liquid flowrates are typically in the range of from about 1 microliter/minute to about 5000 microliters/minute, preferably from about 5 microliters/minute to about 2000 microliters/minute. The ionization chamber (100) or (230) is optionally operated at or near atmospheric pressure, that is, typically from about 660 torr to about 860 torr, preferably at or about 760 torr. Operation above or below atmospheric pressure is possible and may be desirable in certain applications. The temperature within the ionization chamber is typically up to about 500 degrees Celsius. Operation at ambient temperature may be convenient and suitable for some applications. The source of the sample may optionally be a liquid chromatograph, capillary electrophoresis unit, supercritical fluid chromatograph, ion chromatograph, flow injector, syringe pump, infusion pump, or other sample introduction means (not shown). Optionally an inert nebulizing gas, such as nitrogen or carbon dioxide, may be introduced to assist in the formation of the aerosol.

In the embodiment illustrated in FIGS. 1 and 4, the housing (110) and the electrospray assembly (120) are preferably operated at ground, while electrical potentials are applied to the electrode (130), end plate (180), capillary inlet (152), and capillary inlet cap (156A).

In the embodiment illustrated in FIG. 2, a high voltage electrical potential is applied to the corona needle assembly (200) and a corona discharge field is generated within ionization chamber (230).

In FIGS. 1 through 5, the sample leaving the electrospray assembly (120) or the nebulizer assembly (210) is ionized or dispersed into charged droplets under the influence of the generated field within the ionization chamber (100) or (230). The ions or charged droplets may be evaporated and desolvated by heating or under the influence of drying gas introduced into the ionization chamber (100) or (230). In a preferred embodiment, condensation and solvent vapor may be withdrawn from the ionization chamber (100) or (230) through optional drain port or vent (160). In a preferred embodiment, the drain port or vent (160) is substantially 180 degrees opposed to the electrospray assembly (120) or the nebulizer assembly (210). The ions are induced to exit the ionization chamber (100) or (230) via inlet (152) in capillary (151), by application of an electrical potential to the end plate (180). The ions entering the capillary assembly (150) subsequently pass through exit (153) and enter into lower pressure or vacuum chamber(s) (300) and mass analyzer(s) (330). Any suitable mass spectrometer may be used, for example, a quadrupole or multipole, electric or magnetic sector, Fourier transform, ion trap, or time-of-flight mass spectrometer.

In order to remove the capillary (151), such as for inspection, cleaning, or replacement, the ionization source is turned off and the ionization chamber (100) or (230) allowed to cool to a safe temperature. If drying gas is used, the temperature is lowered to a safe level and the mass spectrometer is vented. The ionization chamber is then opened. The end cap (159) is unscrewed, pulled off, or otherwise removed by hand and the capillary (151) is pulled out, again by hand.

In order to reinsert or replace the capillary (151), the capillary (151) is pushed into the capillary receptacle (155A and 155B) by hand, the end cap (159) is screwed, snapped on, or otherwise replaced by hand, the ionization chamber is closed and the mass spectrometer is pumped down and the optional drying gas is adjusted to the appropriate temperature.

Having thus described exemplary embodiments of the invention, it will be apparent that further alterations, modifications, and improvements will also occur to those skilled in the art. Further, it will be apparent that the present invention is not limited to the specific embodiments described herein. Such alterations, modifications, and improvements, though not expressly described or mentioned herein, are nonetheless intended and implied to be within the spirit and scope of the invention. Accordingly, the foregoing discussion is intended to be illustrative only; the invention is limited and defined only by the various following claims and equivalents thereto.

What is claimed is:

1. A mass spectrometry system comprising:

(a) a housing;

(b) at least one ionization region;

(c) a capillary assembly, wherein the capillary assembly provides a means of communication between the ionization region and a lower pressure region;

(d) a capillary receptacle;

(e) means of sealing the capillary assembly within the capillary receptacle; and (f) means of supplying an electrical potential to the capillary;

wherein the capillary assembly is self-positioning and is sealing engaged within the capillary receptacle such that under tension an axial sliding or lateral movement is enabled which disconnects the means of supplying an electrical potential to the capillary assembly and removes the capillary assembly from the capillary receptacle without using tools.

2. The system of claim 1 which further comprises:

a corona needle assembly, and a nebulizer assembly.

3. The system of claim 1 which further comprises:

an electrospray assembly.

4. The system of claim 2 or 3 wherein the ionization region is at or near atmospheric pressure.

5. The system of claim 4 which further comprises:

means of supplying drying gas.

6. The system of claim 5 which further comprises:

a drain port or vent.

7. The system of claim 2 or 3 wherein the nebulizer assembly or the electrospray assembly and the capillary assembly are arranged in substantially cross-flow orientation.

8. The system of claim 2 or 3 wherein the means of sealing the capillary assembly within the capillary receptacle comprise spring loaded fluorocarbon polymer seals.

9. The system of claim 4 further comprising:

a mass analyzer.

10. The system of claim 9 wherein the mass analyzer is a quadrupole or multipole, electric or magnetic sector, Fourier transform, ion trap, or time-of-flight mass spectrometer.

11. The system of claim 9 further comprising:

a liquid chromatograph.

12. An ionization chamber comprising:

(a) a housing;

(b) at least one ionization region;

(c) a capillary assembly, wherein the capillary assembly provides a means of communication between the ionization region and a lower pressure region;

(d) a capillary receptacle;

(e) means of sealing the capillary assembly within the capillary receptacle; and (f) means of supplying an electrical potential to the capillary;

wherein the capillary assembly is self-positioning and is sealing engaged within the capillary receptacle such that under tension an axial sliding or lateral movement is enabled which disconnects the means of supplying an electrical potential to the capillary assembly and removes the capillary assembly from the capillary receptacle without using tools.

13. The chamber of claim 12 which further comprises:

a corona needle assembly, and a nebulizer assembly.

14. The chamber of claim 12 which further comprises:

an electrospray assembly.

15. The chamber of claim 13 or 14 wherein the ionization region is at or near atmospheric pressure.

16. The chamber of claim 15 which further comprises:

means of supplying drying gas.

17. The chamber of claim 16 which further comprises:

a drain port or vent.

18. The chamber of claim 13 or 14 wherein the nebulizer assembly or the electrospray assembly and the capillary assembly are arranged in substantially cross-flow orientation.

19. The chamber of claim 13 or 14 wherein the means of sealing the capillary assembly within the capillary receptacle comprise spring loaded fluorocarbon polymer seals.

* * * * *